US006557446B2

(12) United States Patent
Carlberg et al.

(10) Patent No.: US 6,557,446 B2
(45) Date of Patent: May 6, 2003

(54) APPARATUS FOR CUTTING AND SORTING DIAGNOSTIC STRIPS

(75) Inventors: David L. Carlberg, Twain Harte, CA (US); Ford Garratt, Twain Harte, CA (US); Ted Meigs, Twain Harte, CA (US)

(73) Assignee: Kinematic Automation, Inc., Twain Harte, CA (US)

( * ) Notice: Subject to any disclaimer, the term of this patent is extended or adjusted under 35 U.S.C. 154(b) by 129 days.

(21) Appl. No.: 09/816,432

(22) Filed: Mar. 26, 2001

(65) Prior Publication Data

US 2002/0134210 A1 Sep. 26, 2002

(51) Int. Cl.[7] ..... B26D 7/06; B26D 5/00; B23Q 7/00; B65G 47/34; B07C 5/342

(52) U.S. Cl. ..... 83/102; 83/147; 83/153; 83/155.1; 83/157; 83/160; 83/162; 83/271; 83/365; 83/636; 198/468.9; 209/580; 209/583; 209/587; 209/613

(58) Field of Search ..... 83/147, 102, 107, 83/160, 157, 166, 153, 162, 321, 271, 365, 636, 155.1; 209/576, 577, 580, 583, 587, 613; 198/468.9

(56) References Cited

U.S. PATENT DOCUMENTS 3,430,766 A * 3/1969 Stone ..... 209/524
3,631,979 A * 1/1972 Frankiewicz et al. ..... 209/554
4,342,240 A * 8/1982 Gaiser et al. ..... 226/150
4,773,293 A * 9/1988 Mizuta et al. ..... 83/107
4,794,832 A * 1/1989 Trimble ..... 83/153
4,965,983 A * 10/1990 Muller et al. ..... 53/435
5,142,956 A * 9/1992 Ueno et al. ..... 198/379
5,235,883 A * 8/1993 Jeske et al. ..... 271/303
5,279,195 A * 1/1994 Breton ..... 83/102
6,196,098 B1 * 3/2001 Hagiwara et al. ..... 83/102

* cited by examiner

*Primary Examiner*—Allan N. Shoap
*Assistant Examiner*—Isaac Hamilton
(74) *Attorney, Agent, or Firm*—Harris Zimmerman

(57) ABSTRACT

Diagnostic strips of the kind which are exposed to biological fluids such as blood or urine to detect or monitor medical conditions are cut sequentially from elongated cards by a reciprocating shear blade. The cards may be ones which exhibit defective areas that should not be included in the finished strips. Blade motion seats each newly cut strip on a movable strip carrier which abuts the blade during the cutting operation. The carrier then travels a nondefective strip to a pickup location where it is precisely positioned and picked off of the carrier for emplacement in a housing. A strip with a defective area is carried further to a discharge location where it is released into a waste receptacle. This enables more economical manufacture of diagnostic strips by efficiently making use of nondefective areas of cards that have defective areas.

15 Claims, 9 Drawing Sheets

FIG. 6
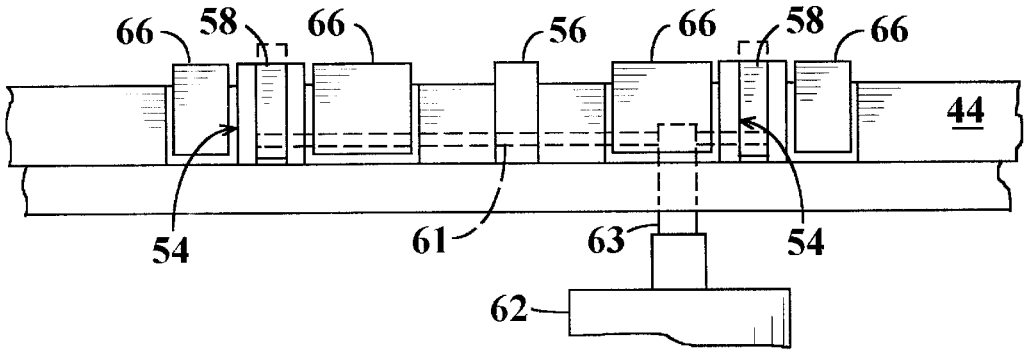
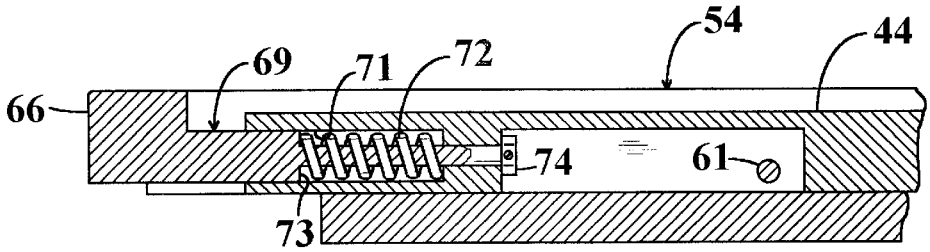
FIG. 7

APPARATUS FOR CUTTING AND SORTING DIAGNOSTIC STRIPS

BACKGROUND OF THE INVENTION

This invention relates to the manufacture of diagnostic strips of the kind used for diagnosis or monitoring of medical conditions. More particularly the invention relates to mechanism for transverse cutting of elongated cards to form a plurality of such strips and for separating out defective strips following the cutting operation.

Diagnostic strips are strips of paper, plastic or other sheet material which are coated with reagents that react to particular substances which may be present in biological fluids such as blood or urine. Typically such strips change color after being immersed in the biological fluid if the particular substance is present in the fluid. This enables a very quick, convenient and economical detection of many medical conditions and facilitates monitoring of patients. As one example, strips sensitive to glucose oxidaise are used in the diagnosis and monitoring of diabetes. Strips sensitive to certain hormones are used to detect pregnancy. Strips having other compositions detect a variety of other physiological conditions. Similar strips are also used for non-medical purposes such as for detecting the presence of particular chemical compositions in a fluid.

The diagnostic strip typically has a backing material formed of paper, plastic or the like to which the chemically sensitive coating material is applied. The coating material may be contained in one or more very thin tissues which are laminated on to the backing material. Applying the coating to each small strip individually would result in undesirably high manufacturing cost. This is avoided during manufacture by applying one or more long ribbons of the coating material to a lengthy piece of the backing material to form what is called a card. Cutting of the card along transverse cut lines produces the strips.

In some prior manufacturing processes the strips are produced by making simultaneous transverse cuts across the card using a rotary cutter having a row of spaced apart cutting disks disposed along an axis of rotation. The groups of strips which are produced simultaneously in this manner are then packaged or passed on to other mechanism for further processing. Prior U.S. Pat. No. 5,067,309 and prior U.S. Pat. No. 5,816,030 disclose examples of rotary strip cutting mechanism of this kind. In other prior manufacturing processes the strips have been produced sequentially by cutting successive strips from the card using a reciprocating cutting blade. Prior cutting mechanisms of either form do not enable performance of certain post cutting operations in a desirably efficient and economical manner.

Cards can on occasion have areas with visible manufacturing defects or areas which have been inadvertently contaminated with a foreign substance. Finished strips formed from such areas or containing portions of such areas may not function in the intended manner. The prior practice does not provide desirably efficient and economical arrangements for assuring that finished strips are free from defective areas of this kind. Individual inspection of each cut strip is at best a costly complication of the manufacturing process. Discarding of an entire card because of a small localized defective area results in wastage of other portions of the card material.

In many cases individual strips are emplaced in a housing formed of plastic or other material to form a kit which facilitates use of the strip. The housing may have openings for admitting fluid and for observing the effects of the fluid on the strip. Any mechanism for moving the cut strips from the cutter to the housings must bring the strips into precise registration with the housings as the strips typically are tightly fitted into recesses in the housings. The prior art does not provide desirably efficient and economical mechanism for this purpose.

The present invention is directed to overcoming one or more of the problems discussed above.

BRIEF SUMMARY OF THE INVENTION

In one aspect of the present invention, apparatus for cutting transverse strips from an elongated card and for sorting defective strips from non-defective strips includes a die member having a shear zone defining edge across which successive transverse portions of the card may be traveled. A reciprocatable shear blade is adjacent to the die member and has a cutting edge which is positioned to cut transverse strips from the card at the shear zone defining edge in a sequential manner. A strip transporting carrier is supported for movement between a first location at which a front end of the carrier abuts the die member in position to receive and support strips which are cut from the card, a second location at which non-defective strips are removable from the carrier and a third location at which defective strips are released from the carrier.

In another aspect of the invention, apparatus for cutting transverse strips from an elongated card and for sorting defective strips from non-defective strips includes a die member having a horizontal slot into which successive transverse portions of the card may be traveled, the slot forming a shear zone defining edge. A shear blade is disposed against the die member and has a cutting edge positioned to cut transverse strips from the card at the shear zone defining edge as the blade is reciprocated in a vertical direction. The shear blade has an inclined surface which extends upward from the cutting edge and outward from the die member. A strip transporting carrier has a platen for supporting newly cut strips, the carrier being movable along a horizontal strip travel path which extends away from the shear zone defining edge of the die member. The carrier is movable from a first location at which a front end of the carrier is against the die member in position to receive and support a newly cut strip to a second location at which nondefective strips are removed from the carrier and is further movable to a third location at which defective strips are released from the carrier. The front end of the carrier is formed by a plurality of strip supports which are retractable into the platen portion of the carrier. The strip supports are urged into the platen by the inclined surface of the shear blade as the blade travels downward during a cutting operation. This moves the newly cut strip onto the platen.

The invention provides for economical and efficient sorting of defective diagnostic strips from non-defective strips after cutting of the strips from elongated cards which may include cards having defective areas. The strips are cut from the card in a sequential manner by a reciprocating shear blade. Each newly cut strip is received by a strip transporting carrier. The carrier moves non-defective strips to a first location at which they are picked off of the carrier for transfer to a housing or other processing. If the strip is a defective one continued motion of the carrier takes the strip to another location at which it is released into a waste receptacle. Structural features of the preferred form of the invention provide for precise positioning of the cut strips on the carrier at the pick up location thereby enabling precise registration of the strips with housings into which they are tightly fitted.

The invention, together with further objects and advantages thereof, may be further understood by reference to the following Detailed Description of the Invention and by reference to the accompanying drawings.

BRIEF DESCRIPTION OF THE DRAWINGS

FIG. 6 is a front elevation view of a portion of the strip transporting carrier taken along line 6—6 of FIG. 5.

FIG. 7 is an elevation section view of a portion of the strip transporting carrier taken along line 7—7 of FIG. 5.

DETAILED DESCRIPTION OF THE INVENTION

Figure 1:
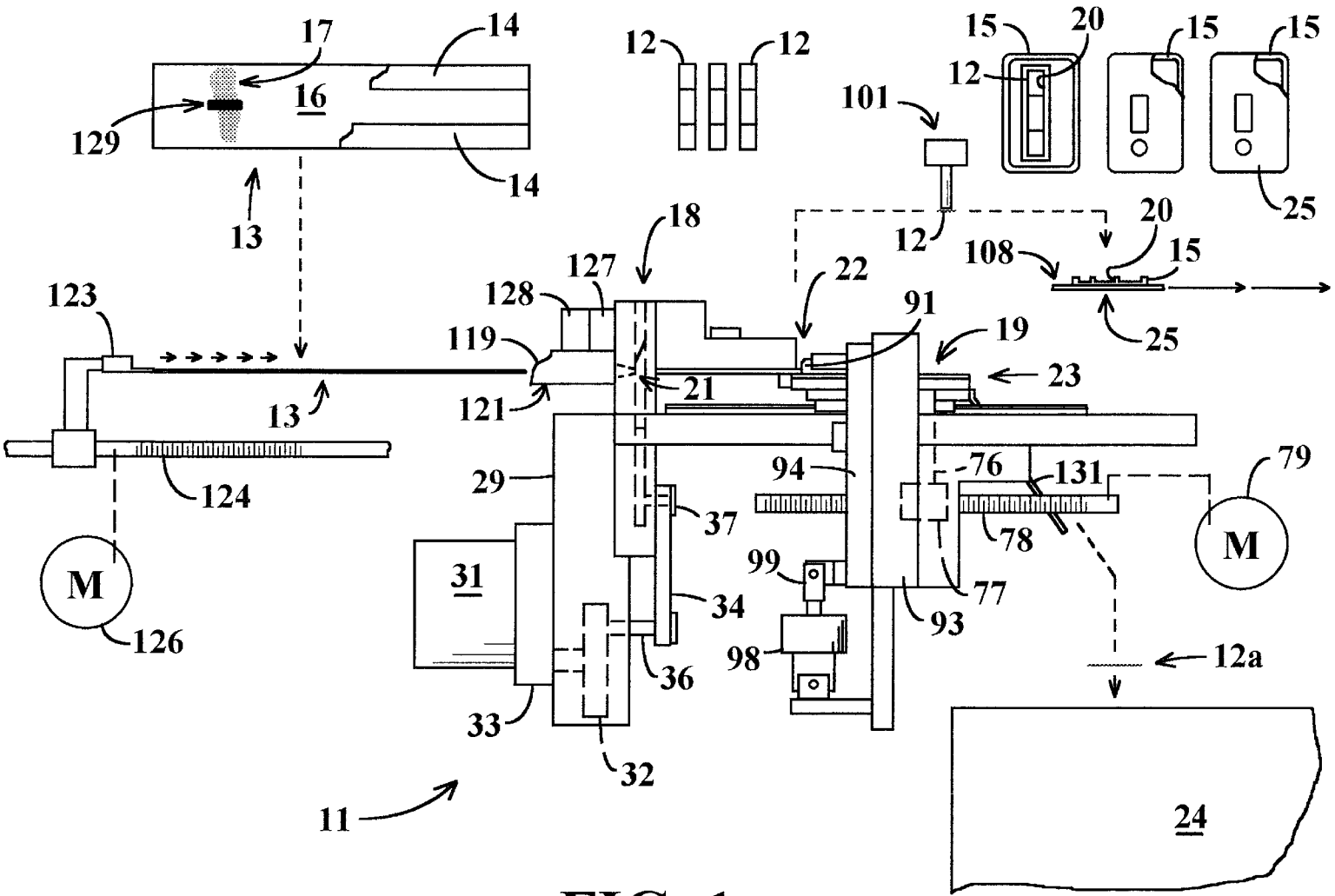
FIG. 1 is a side elevation view of diagnostic strip cutting and sorting apparatus embodying the invention, certain components being shown in schematic form.

Referring initially to FIG. 1 of the drawings, strip cutting and sorting apparatus 11 embodying the invention is designed to cut transverse strips 12 from elongated rectangular cards 13 in a sequential manner. The cards 13 may be of the known diagnostic form which are coated with reagents that change color upon exposure to specific substances in biological fluids. The reagents are typically contained in laminated ribbons 14 of thin tissue like material that extend along opposite boundary regions of one surface of a backing material 16. The apparatus 11 may also be used to cut transverse strips from other types of card.

Cards 13 may on occasion exhibit visible defective areas 17 which can arise during manufacture or from exposure of the card to foreign substances. Strips containing such areas 17 or portions of such areas may not function properly and should not be present in the finished product. Cutting and sorting apparatus 11 enables efficient sorting of defective strips 12*a* from the nondefective strips 12.

Each card 13 is fed end wise into a cutter unit 18 which cuts the strips 12, 12*a* from the card in a sequential manner. A movable strip transporting carrier 19 separately carries each newly cut nondefective strip 12 from a first location 21 at which the cutting operation takes place to a second location 22 at which the strip is picked off of the carrier by pickup mechanism 101 which will hereinafter be described. Defective strips 12*a* are carried further by the carrier 19 to a third location 23 at which the strip is released from the carrier into a waste receptacle 24.

In this example of the invention, pickup mechanism 101 emplaces each non-defective strip 12 in one of a series of flat plastic housings 15 which are brought to a housing loading location 25 by a conveyer belt 108. The housings 15 are subsequently provided with covers 25 to form test kits such as pregancy test kits, for example. The kits may be of the known form in which covers 25 have openings through which fluid may be admitted and for observing the central region of the strips. The strip 12 is emplaced in a recess 20 within housing 15 that has a rectangular configuration conforming with the outline of the strip. The strip 12 fits tightly into the recess 20 in order to prevent it from shifting position. This requires that the strip 12 be in precise register with recess 20 as it is being entered into the recess. That in turn requires that the strip 12 be precisely positioned and oriented at the pickup location 22.

Figure 2:
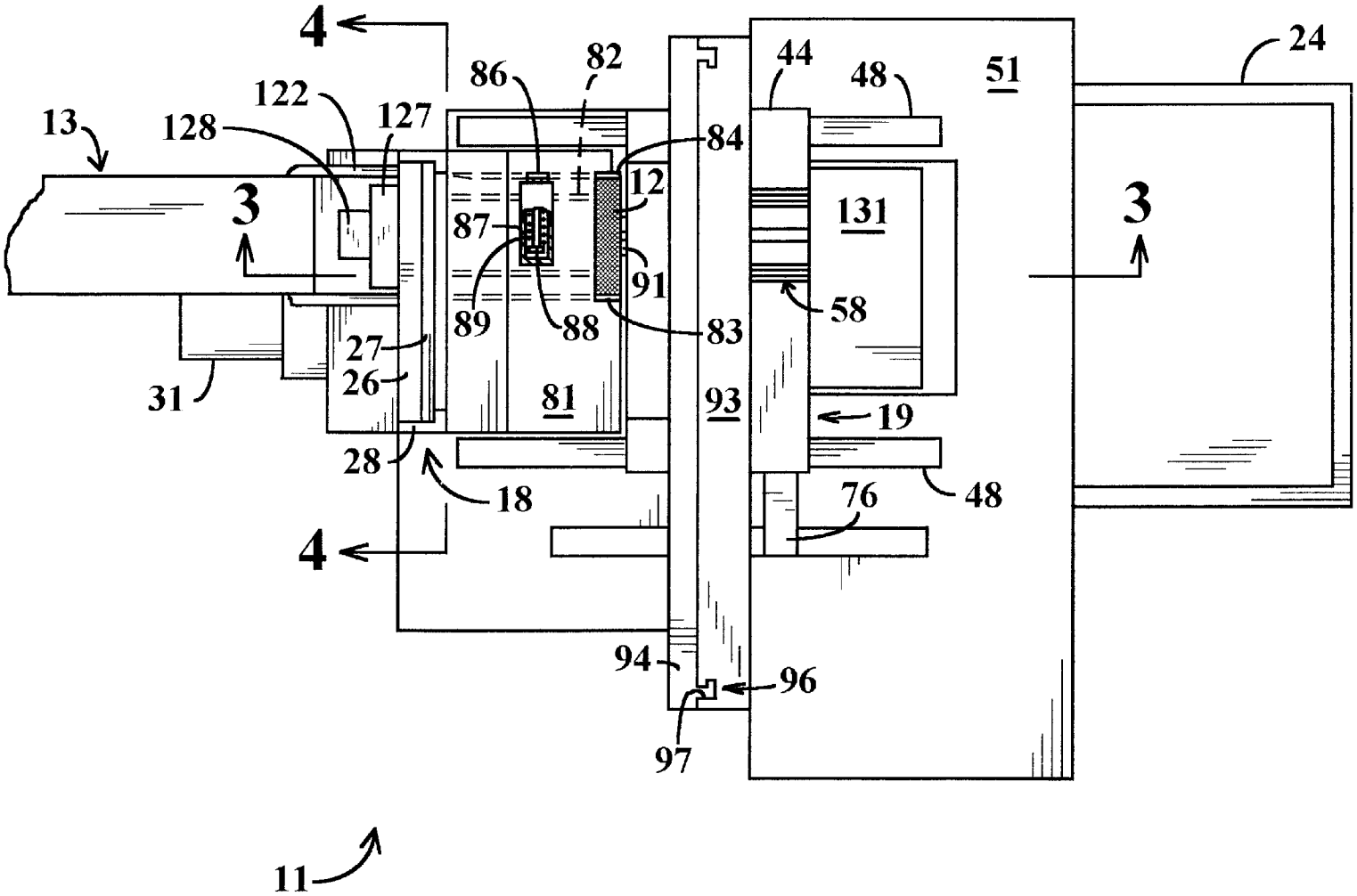
FIG. 2 is a top view of the apparatus of FIG. 1.
Figure 3:
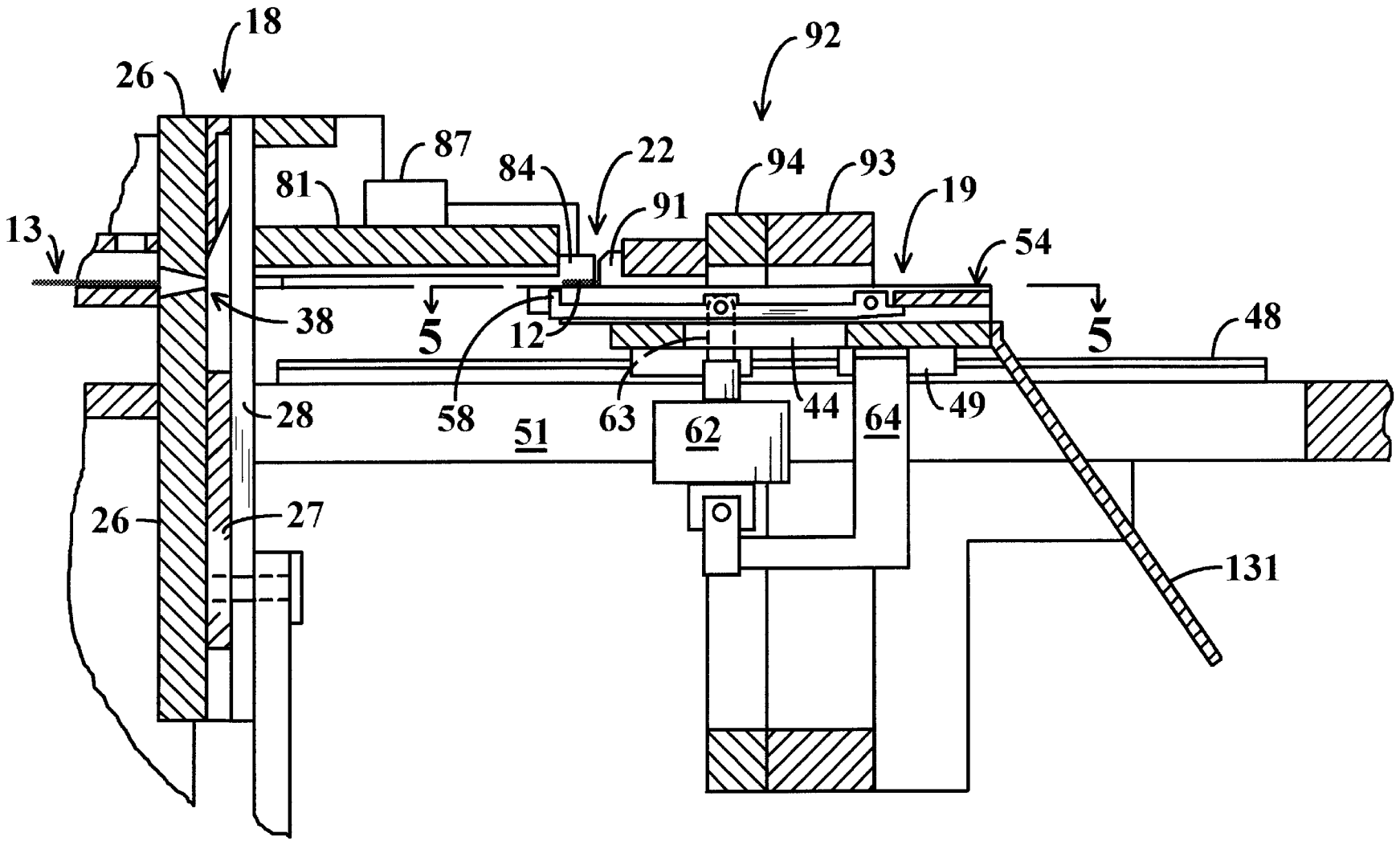
FIG. 3 is a longitudinal section view of a portion of the apparatus of the preceding figures taken along line 3—3 of FIG. 2.

Referring jointly to FIGS. 2 and 3, the cutter unit 18 of this particular example of the invention includes a vertically extending rectangular die member 26 and a reciprocating rectangular shear blade 27 disposed against the back surface of the die member in parallel relation ship with the die member. Track members 28 of right angled cross section extend from each side of die member 26 and along edge regions of the back of shear blade 27 to hold the blade against the die member. Referring to FIGS. 1 and 2, die member 26 is supported by a downward extending portion 29 of the framing of the apparatus 11 which also supports an electrical servomotor 31. Servomotor 31 turns a crank wheel 32 within framing portion 29 through a speed reducing gearbox 33. The lower end of a crank arm 34 is pivoted to wheel 32, at an off center location on the wheel, by a pivot pin 36. The upper, end of crank arm 34 is coupled to shear blade 27 through another pivot pin 37. Thus operation of servomotor 31 causes vertical reciprocation of shear blade 27 relative to die member 26.

Figure 4:
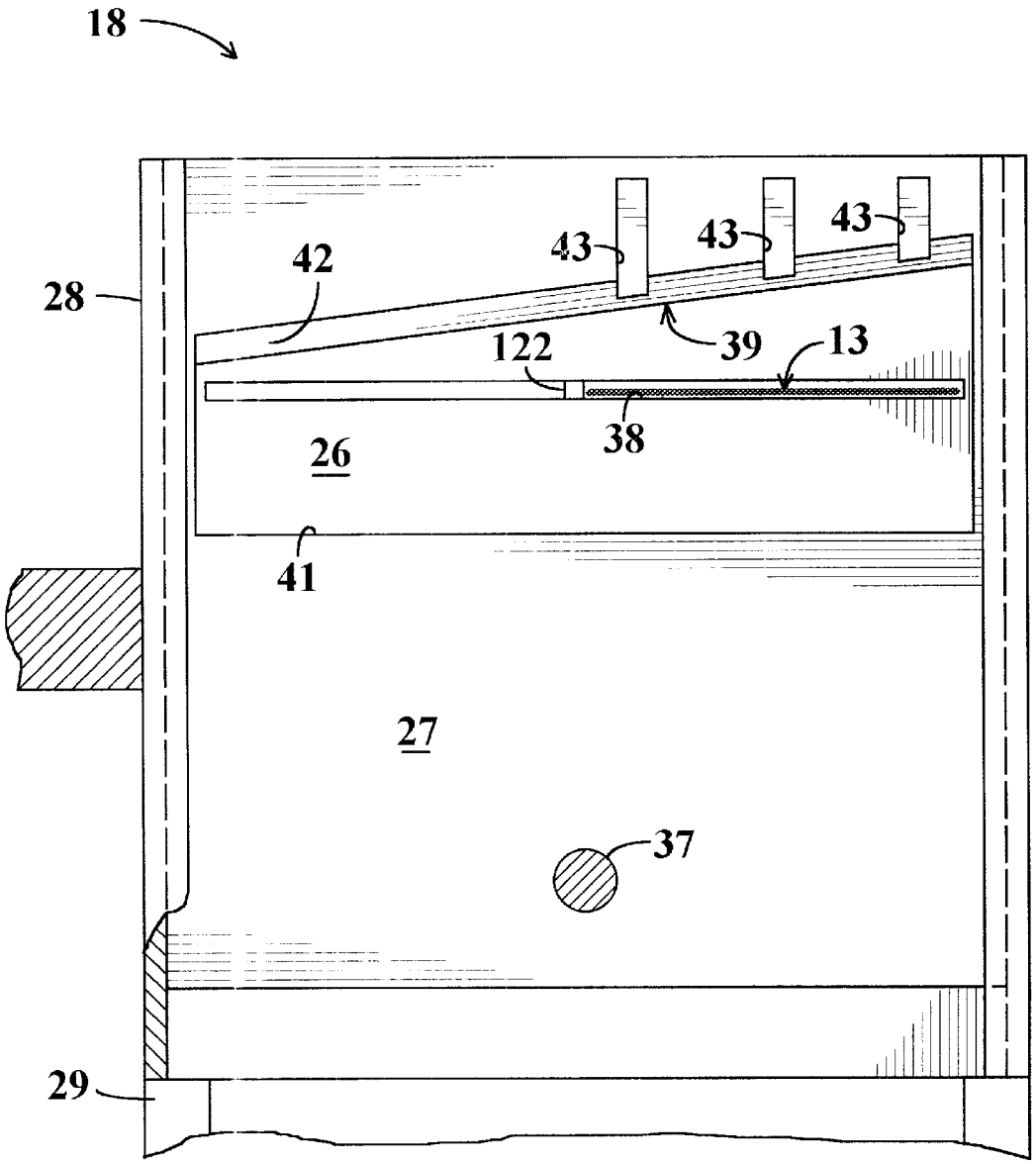
FIG. 4 is a cross section view of a portion of the apparatus of the preceding figures taken along line 4—4 of FIG. 2 and showing strip cutting components of the apparatus.

Referring to FIGS. 3 and 4 in conjunction, the shear zone at which successive strips are cut from the cards 13 is defined by the lower edge of a horizontal slot 38 in die member 26 into which the cards are fed. The upper edge 39 of a trapezoidal opening 41 in shear blade 27 is a cutting edge of the blade and is sloped so that each cutting of a strip proceeds progressively along a transverse cut line on the card. The shear blade 27 has a surface 42 immediately above the cutting edge 39 which is inclined to extend outward from die member 26. The inclined surface 42 urges cut portions of the strip outward from the die member 26 as cutting of the strip progresses in a manner which will hereinafter be further described. Three spaced apart vertical grooves 43 in the back surface of shear blade 27 extend upward from the inclined surface 42 to enable entry of strip transporting components into the blade as will also hereinafter be further described.

The die member 26, including slot 38, and shear blade 27 of this example of the apparatus are considerably broader than the particular cards 13 which are being cut. This facilitates adaptation of the apparatus for cutting cards of different widths.

Figure 5:
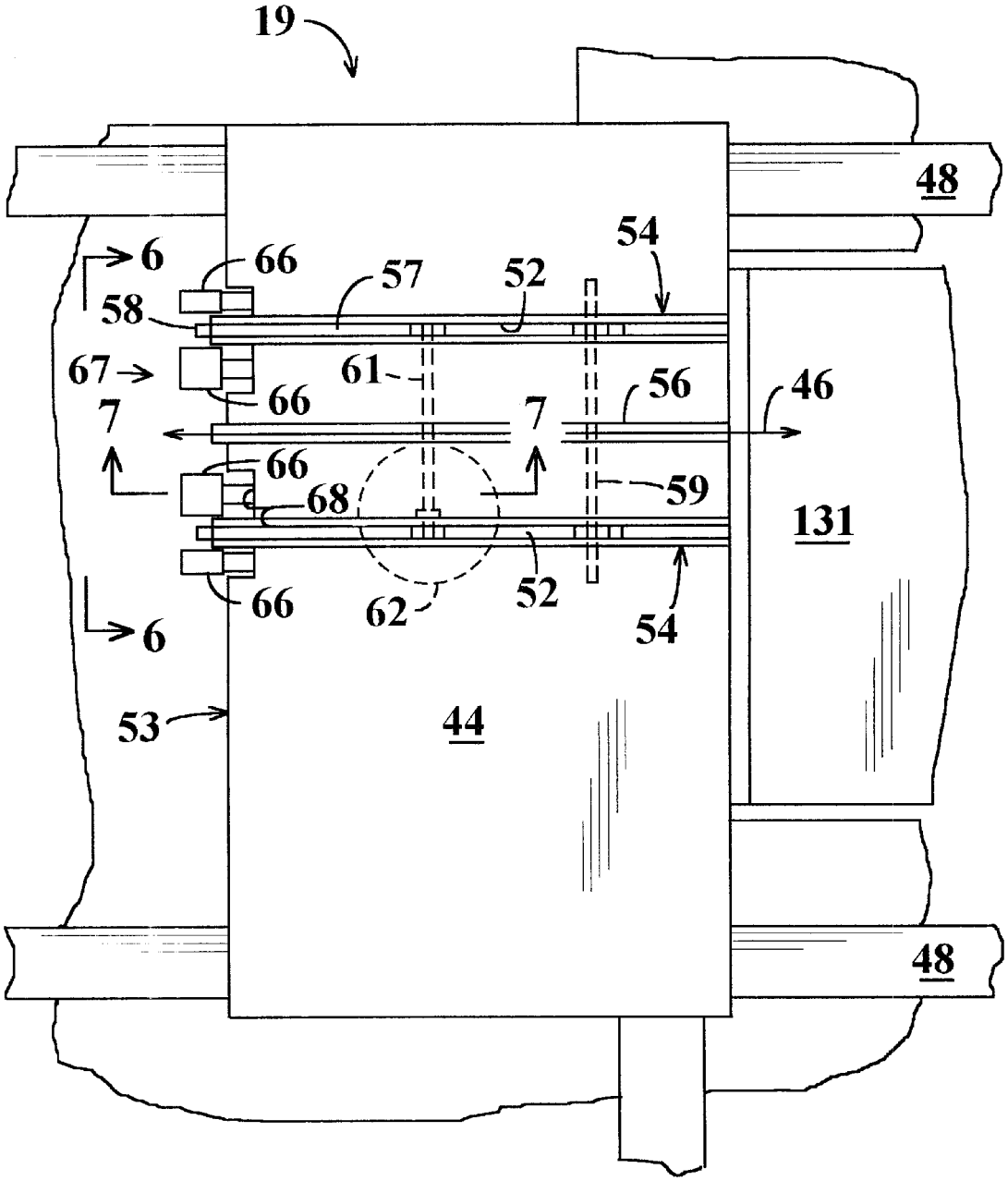
FIG. 5 is a top view of a strip transporting carrier component of the apparatus taken along line 5—5 of FIG. 3.

Referring jointly to FIGS. 3 and 5, the strip transporting carrier 19 of this example of the invention has a platen 44 which is traveled towards the strip cutter 18 and away from the strip cutter along a strip travel path 46 which extends horizontally from the shear zone 38 at die member 26. The platen 44 rides on a pair of spaced apart rails 48 which are engaged by sliding shoes 49 at the underside of the platen. Rails 48 are secured to a horizontal portion 51 of the framing of the apparatus 11.

Referring jointly to FIGS. 3, 5 and 6, parallel thin slots 52 in platen 44 extend from the front end 53 of the platen 44 to a location near the back end of the platen. Platen 44 is formed to have raised ribs 54 which extend along each side of the top of each slot 52 and which also extend outward towards die member 26 at the front of the platen. Another raised rib 56 extends along the top of the platen 44 at a location which is midway between the pairs of ribs 54. Newly cut strips 12 which are being traveled by the carrier 19 rest on the ribs 54 and 56.

A pivot arm 57 extending along each slot 52 has an upwardly directed strip containment finger 58 at its front end, the finger being immediately in front of the ribs 54 which bound the slot. Arms 57 are coupled to the platen 44 by a pivot axle 59 which extends transversely within the platen thereby enabling fingers 58 to be moved in a vertical direction by pivoting of the arms. A cross link rod 61 extends between the arms 57 at a location forward from pivot axle 59 to enable joint raising and lowering of the fingers 58 by a single actuator 62 of the type having an extensible and retractable rod 63. Actuator 62, which may be any of the pneumatic, hydraulic or electrical type, is pivoted to a bracket 64 which extends down from platen 44 and the extensible and retractable rod 63 engages cross link rod 61. As best seen in FIG. 6, fingers 58 are proportioned to be flush with the tops of ribs 54 and 56 when in the lowered position and to extend above the ribs when in the raised position.

In conjunction with other structure to be described, fingers 58 assure that a newly cut strip is precisely positioned on the platen 44 in a transverse orientation and remains at that position during travel towards the strip pickup location 22. As may be seen in FIG. 9, the fingers 58 are within the shear blade 27 when cutting of a new strip begins. The fingers 58 are in the lowered position and are within shear blade opening 41 at that time. The previously described vertical grooves 43 in the shear blade 27 allow fingers 58 to remain in the blade as the blade descends and the cutting operation continues. Descent of the inclined surface 42 of the blade 27 moves the newly cut strip out of the blade and on to platen 44. Fingers 58 are then raised to contact the adjacent edge of the newly cut strip and thereby maintain it in a transverse orientation as it is traveled away from the blade by the carrier 19.

In the absence of preventive measures, the shear blade 27 would tend to wedge strips downward between fingers 58 and die member 26 as cutting of the strip progresses. This is avoided by a series of spaced apart retractable strip supports 66 at the front end 67 of carrier 19, there being four such strip supports in this example of the invention. Referring jointly to FIGS. 3, 5 and 7, the strip supports 66 extend outward from platen 44 except when cutting of a strip is progress. During a cutting operation, the descending inclined surface 42 of the shear blade 27 forces the strip supports 66 into notches 68 in platen 44. This moves newly cut portions of the strip on to platen 44 without the wedging effect discussed above.

The strip supports 66 are retractable as the supports have stems 69 which extend into openings 71 in the front of platen 44. Compression springs 72 in openings 71 act against steps 73 on the stems 69 to urge the supports in an outward direction. Stops 74 at the inner ends of the stems 69 limit the outward movement.

Movement of the strip transporting carrier 19 can be effected with a motor or actuator of any various kinds. In this example, with reference to FIG. 1, an arm 76 extends downward from the carrier 19 to an internally threaded sleeve 77. Sleeve 77 engages on a horizontally extending lead screw 78 which is turned by an electrical servomotor 79 to travel the carrier 19 between the above described locations of the carrier.

Figure 9:
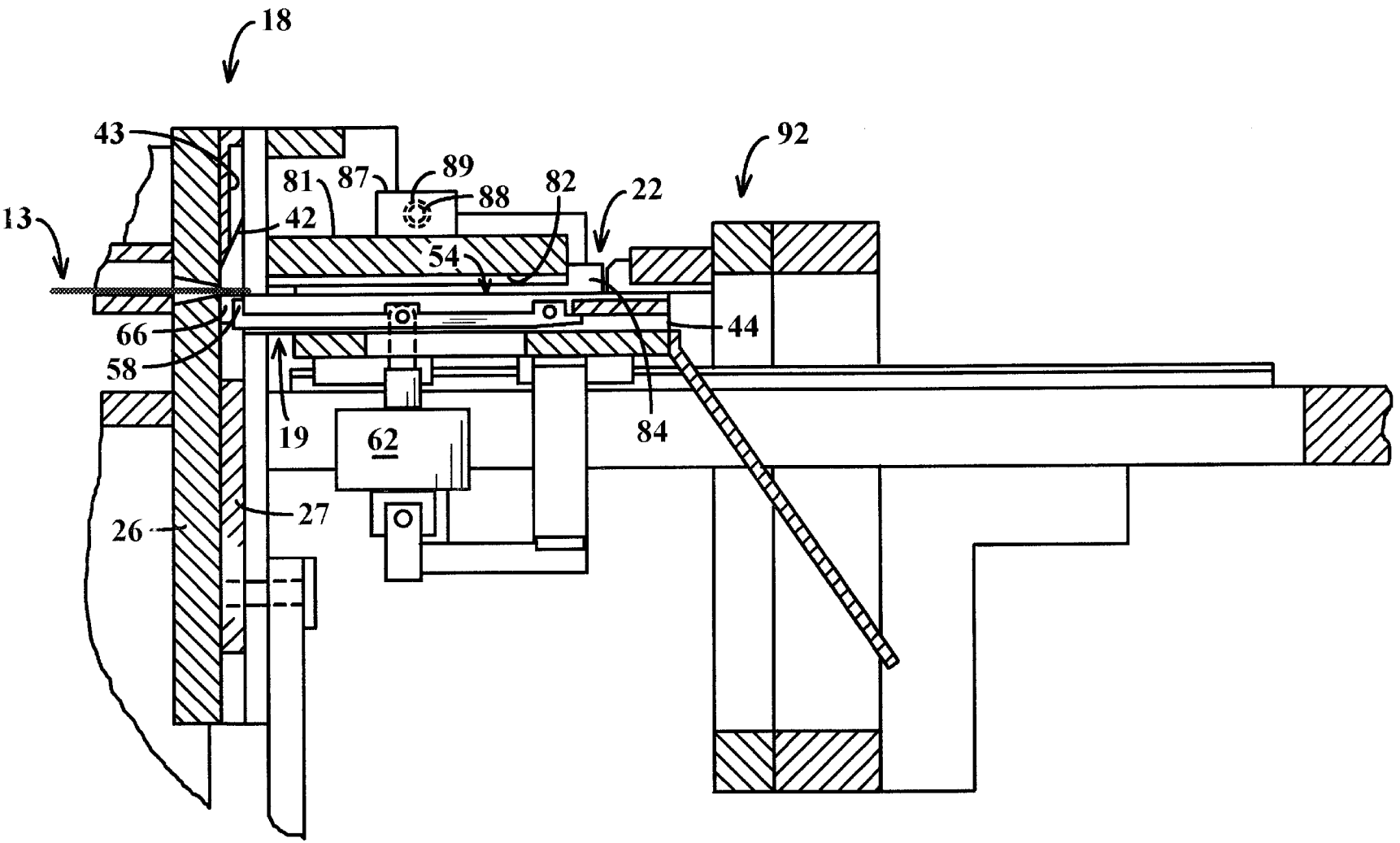
FIG. 9 is a longitudinal section view of a portion of the apparatus corresponding generally to FIG. 3 except that the strip transporting carrier is shown shifted to a cut strip receiving position.

Referring jointly to. FIGS. 2 and 9, precise positioning of each strip 12 on the carrier 19 is further provided for by a top containment plate 81 which extends horizontally between the cutting unit 18 and the strip pickup location 22. Spacing of the bottom surface of top containment plate 81 from the top of carrier 19 is just slightly greater than the thickness of the strips 12. Longitudinal grooves 82 in the bottom surface of top containment plate 81 are entered by the tops of the strip containment fingers 58 of carrier 19 when the fingers are in the raised position.

Movement of strips 12 at right angles to the direction of travel is blocked by strip end guides 83 and 84 which extend along opposite sides of the strip travel path. End guides 83 and 84 extend down from top containment plate 81 to a level which is slightly below the level of the tops the platen ribs 54 on which the strips rest. End guide 83 is a fixed end guide fastened directly to the top containment plate 81. The other end guide 84 is a retractable end guide which is movable towards the fixed end guide 83 and away from the fixed end guide within a small range of travel in order to accommodate to slight variations in the length of strips 12. Retractable end guide 84 has a tab 86 which extends up to a location which adjacent to a spring housing 87 situated at the top of containment plate 81, and is secured to a horizontal rod 88 which extends into the housing at right angles to the path of travel of carrier 19. A spring 89 within housing 87 urges rod 88 and thus retractable end guide 84 in the direction of the fixed end guide 83. The retractable end guide 84 is positioned to be urge slightly away from the fixed end guide 83 by strips 12 entering the region between the end guides and thus exerts a light pressure against the strip which acts to hold the other end of the strip in abutment against the fixed end guide 83. This assures precise positioning of the ends of strips 12 on carrier 19.

Referring to FIGS. 2 and 3 in conjunction, positioning of nondefective strips 12 at the pickup location 22 is completed by transversely extending front edges of a pair of spaced apart registration guides 91 which are components of a lift gate assembly 92. Assembly 92 has a vertically oriented rectangular fixed frame 93, secured to the previously described framing portion 51 of the apparatus, which extends around the path of travel of carrier 19. A lift gate 94 which is also a vertically oriented rectangular frame, is disposed against fixed frame 93. The lift gate 94 has vertically extending rails 96 of angled cross section which are entered into conforming grooves 97 in the fixed frame 93. This enables vertical movement of the lift gate 94 relative to the fixed frame 93 and relative to the strip transporting carrier 19. Referring to FIG. 1, vertical movement of the lift gate 94 is effected by another actuator or cylinder 98 of the form having an extensible and retractable rod 99 and which may be of the pneumatic, hydraulic or electrical type.

Figure 8:
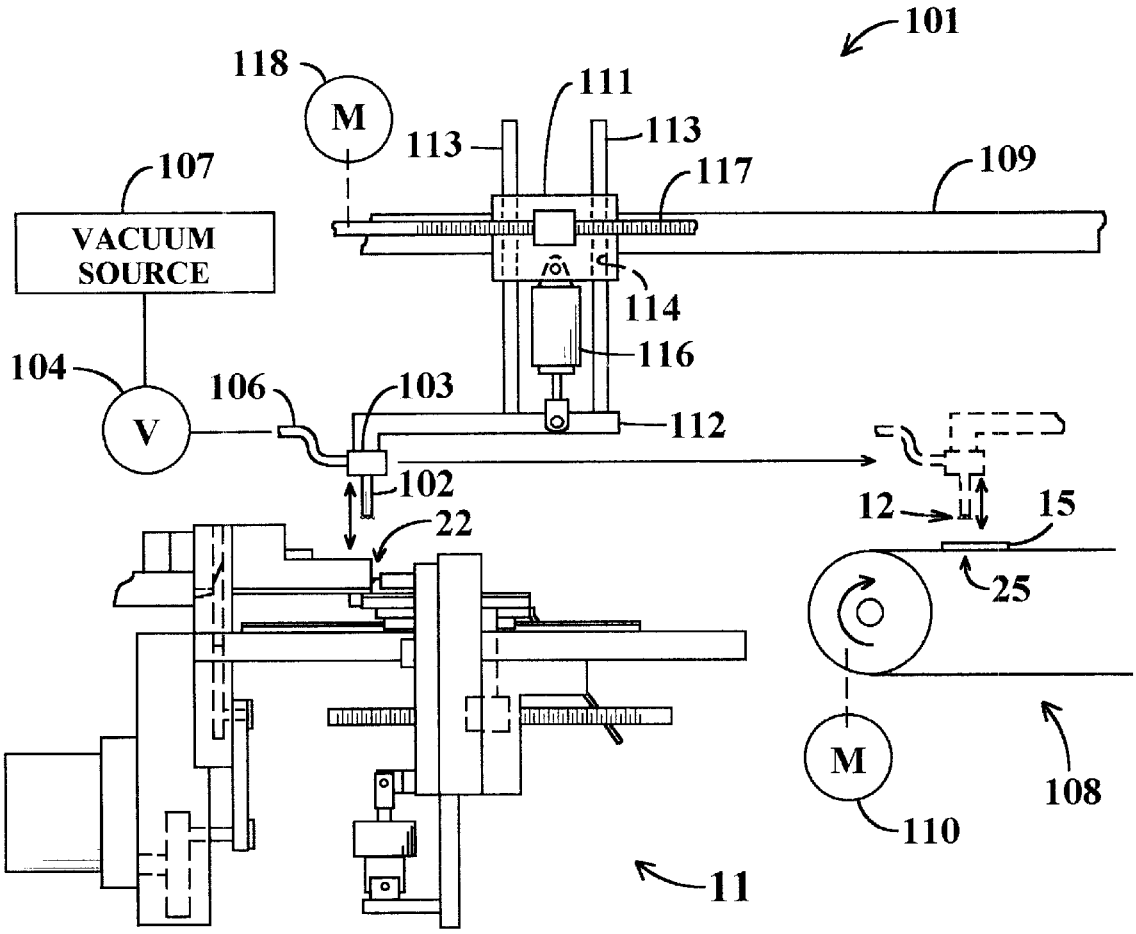
FIG. 8 is a side elevation view of the strip cutting and sorting apparatus including suitable mechanism for removing cut strips from the apparatus.

Referring again to FIGS. 2 and 3, registration guides 91 are integral portions of the lift gate 94 that extend down to carrier ribs 54 when the gate is at the lowered position. The lowered guides 91 are abutted by nondefective strips 12 as the strips arrive at the pickup location 22 along the strip travel path. Referring to FIG. 8, nondefective strips 12 are lifted away from the pickup location 22 by the pickup mechanism 101. In this example of the invention the pickup mechanism 101 has a pair of vertically oriented suction tubes 102 which extend downward from a vacuum housing 103. Housing 103 and tubes 102 are movable in a vertical direction to bring the bottom ends of the tubes 102 into contact with nondefective strips 12 which have arrived at the pickup location 22. A flexible conduit 106 is connected between housing 103 and a vacuum source 107 through a valve 104. Valve 104 is opened when the tubes 102 arrive at the pickup location 22 to create suction which causes the strip 12 to cling to the bottoms of the tubes 102. Housing 103 and tubes 102 are then traveled upward and then horizontally and then downward to emplace the strip 12 in a housing 15 in the previously described manner. The housings 15 are brought to the loading position 25 by conveyor belt 108 which is driven by another servomotor 110. Closure of valve 104 at that time releases the strip 12 from the suction tubes 102.

The pickup mechanism 101 includes a horizontal rail 109 which extends in the direction of travel of housing 103 and a support block 111 is slidable along the rail. Housing 103 is secured to an arm 112 which extends in parallel relationship with rail 109 below the rail. Spaced apart vertical rods 113 extend up from arm 112 through vertical passages 114 in block 111. The above described vertical motion of housing 103 and suction tubes 102 is effected by another extensible and contractible actuator 116 connected between arm 112 and slidable block 111. The block 111 is traveled along rail 109 to provide the horizontal movement by a leadscrew 117 driven by another servomotor 118.

Referring jointly to FIGS. 1 and 2, cards 13 which are to be cut into strips 12 are fed into the cutter unit 18 along a card guide 119 having a floor 121 and upward extending side walls 122. In this example a ram member 123 abuts the end of the card 13 within guide 119 and is traveled along the guide to force the card into the cutter unit 18. Ram member 123 is traveled by another lead screw 124 driven by another servomotor 126. The card 13 is preferably traveled in a stepped manner with each increment of movement having a length equal to the desired width of the strips 12. Servomotor 126 is preferably of the programable type to enable selective changing of the length of the stepping movements of ram member 123 in order to change the width of the strips 12 which are being produced.

The herein described operations of the servomotors 31, 79, 110, 118 and 126, valve 104 and actuators 62, 98 and 116 can be preprogrammed and sequenced by automatic controls if desired.

Incipient entry of a defective area 17 of a card 13 into cutter unit 18 can be detected by an optical sensor 127 situated above guide 119 at the entrance to the cutter unit. A lamp 128 illuminates the region of the card 13 that is passing under sensor 127. When an optical sensor 127 is used, the cards 13 are preferably manually inspected prior to being fed into the cutting and sorting apparatus 11 and defective areas 17 are emphasized by marks 129 made with a marking pen or the like, the markings being black or of some other color that contrasts with the color of the card.

Figure 10:
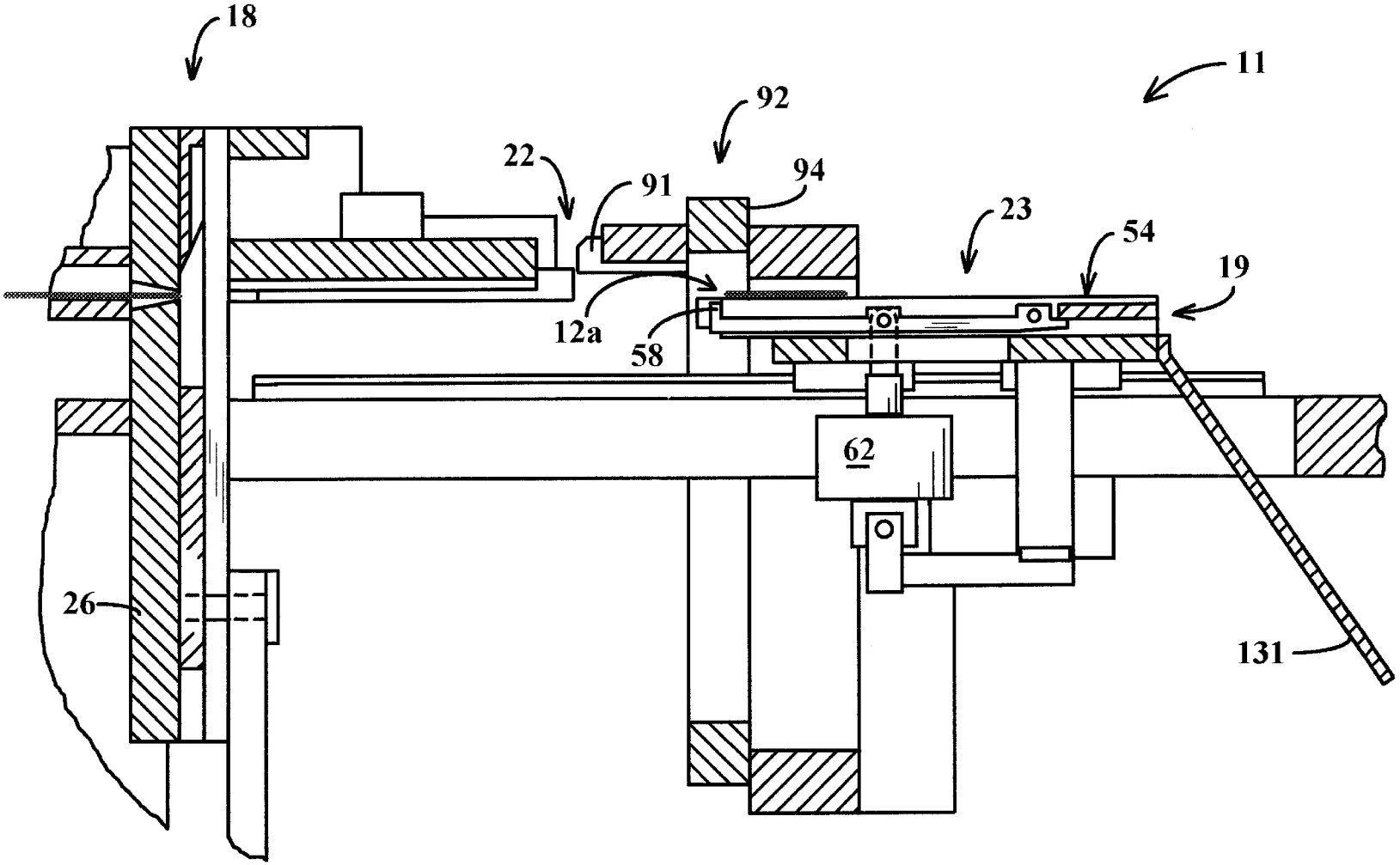
FIG. 10 is another longitudinal section view of a portion of the apparatus corresponding generally to FIG. 3 except that the strip transporting carrier is shown shifted to a reject strip discarding position.

Upon entry of a defective area 17 into the cutter unit 18, with reference jointly to FIGS. 1 and 10, actuator 98 is operated to shift lift gate 94 including registration guide 91 to the raised position. Preferably, the next cutting operation at the cutter unit 18 is then delayed until the entire defective area 17 has passed through die member 26. The strip transport carrier 19 is then traveled beyond the pickup location 22 to the third location 23 as depicted in FIG. 10. This locates the defective portion 12*a* of the card, which is being transported by carrier 19, beyond the registration guide 91. Referring again to FIGS. 1 and 10, the lift gate 94 including registration guide 91 is then lowered by operation of actuator 98 to reposition the registration guide against ribs 54 of the carrier 19. Strip containment fingers 58 are lowered by operation of actuator 62. Servomotor 79 is then operated to return the carrier 19 to cutter unit 18 in preparation for receipt of another strip.

During the return motion of the carrier 19 the defective portion 12*a* of the card is scraped off of the back end of the carrier by the back surface of the lowered registration guide 91. A chute 131 extends outward and downward from the back of carrier 19 to guide the rejected portion 12*a* of the card into waste receptacle 24.

While the invention has been described with reference to a single preferred embodiment for purposes of example many modifications and variations are possible and it is not intended to limit the invention except as defined in the following claims.

What is claimed is:

1. Apparatus for cutting transverse strips from an elongated card and for sorting defective strips from non-defective strips, comprising:

a die member having a shear zone defining edge across which successive transverse portions of said card may be traveled, a reciprocatable shear blade which is adjacent to said die member and which has a cutting edge which is coplanar with said shear zone defining edge of said die member and positioned to cut transverse strips from said card at said shear zone defining edge in a sequential manner, and a strip transporting carrier supported for movement between a first location at which a front end of said carrier is adjacent to said die member at said shear zone defining edge thereof in position to receive and support strips which are cut from said card, a second location at which non-defective strips are removable from said carrier and a third location at which defective strips are released from said carrier, wherein said carrier conveys strips along a strip travel path which extends from said first location through said second location to said third location, and, a vertically movable lift gate disposed at said strip travel path between said second and third locations, said lift gate having a lowered position at which movement of said strips from said second location to said third location is blocked and having a raised position at which said strip travel path is open for movement of strips from said second location to said third location.

2. The apparatus of claim 1 wherein said lift gate carries a strip registration guide having a front surface positioned to be abutted by edges of strips arriving at said second location when the lift gate is at the lowered position thereof, said strip registration guide having a back surface positioned to scrape defective strips off of said carrier as said carrier returns towards said second location from said third location with said lift gate in said lowered position thereof.

3. The apparatus of claim 1 wherein said strip transporting carrier includes a pair of spaced apart movable strip containment fingers, said fingers having a lowered position at which the fingers are below said strip travel path and a raised position at which the fingers extend above the strip travel path in position to contact edges of said strips which are being carried along said strip travel path by said carrier.

4. The apparatus of claim 3 wherein said reciprocatable shear blade has at least a pair of vertical grooves extending upward from said cutting edge in position to be entered by said fingers when said front end of said carrier is abutted against said die member and wherein said shear blade has a blade surface which extends upward from said cutting edge and which is inclined towards said carrier which inclined surface urges newly cut strips past said fingers as the shear blade descends.

5. The apparatus of claim 4 wherein said carrier has a platen which supports said strips, said front end of said carrier being formed by a plurality of retractable strip supports positioned to abut said die member at said shear zone defining edge thereof, said strip supports being retractable into said platen, said retractable strip supports being urged into said platen by said inclined surface of said shear blade as said shear blade descends.

6. The apparatus of claim 3 wherein said strip containment fingers are pivoted to said carrier and wherein said carrier further includes an extensible and contractible actuator coupled to said strip containment fingers to move said fingers between said lowered and raised positions thereof.

7. The apparatus of claim 3 further including a top containment plate disposed above said strip travel path and extending between said firsthand second locations and having a bottom surface which faces said path and which is parallel thereto, said top containment plate having a pair of spaced apart parallel grooves which extend along said bottom surface and into which tips of said fingers extend when said fingers are in the raised position.

8. The apparatus of claim 7 further including first and second strip end guides attached to said top containment plate and extending along opposite sides of said strip travel path between said first and second locations.

9. The apparatus of claim 8 further including means for enabling adjustment of the spacing of said first and second strip end guides from each other.

10. Apparatus for cutting transverse strips from an elongated card and for sorting defective strips from non-defective strips, comprising:

a die member having a vertically extending surface with a horizontal slot therein into which successive transverse portions of said card may be traveled, said slot forming a shear zone defining edge, a vertically reciprocatable shear blade disposed against said die member and having a cutting edge positioned to cut transverse strips from said card at said shear zone defining edge as the blade reciprocates, said shear blade having an inclined surface which extends upward from said cutting edge and outward from said die member, a strip transporting carrier having a platen for supporting newly cut strips, said carrier being movable along a horizontal strip travel path which extends away from said shear zone defining edge of said die member, said carrier being movable from a first location at which a front end of said carrier is against said die member in position to receive and support a newly cut strip to a second location at which nondefective strips are removed from said carrier and being further movable to a third location at which defective strips are released from said carrier, said front end of said carrier being formed by a plurality of strip supports which are retractable into said platen, said strip supports being urged into said platen by said inclined surface of said shear blade as said shear blade travels downward during a cutting operation.

11. The apparatus of claim 10 wherein said strip transporting carrier includes spaced apart strip containment fingers, said fingers having a lowered position at which the fingers are below said strip travel path and a raised position at which the fingers extend above the strip travel path in position to contact edges of said strips which are being carried along said strip travel path by said carrier, and wherein said shear blade has spaced apart vertical grooves which extend upward from said inclined surface of the blade, said grooves being positioned to receive said fingers when said strip transporting carrier is at said first location.

12. The apparatus of claim 10 further including a lift gate disposed at said strip travel path between said second and third locations, said lift gate having a lowered position and a raised position, said lift gate having a strip registration guide positioned to be abutted by strips arriving at said second location when the lift gate is at the lowered position, the registration guide being above said strip travel path when the lift gate is at the raised position thereby enabling further travel of said strips to said third location.

13. Apparatus for cutting transverse strips from an elongated card and for sorting defective strips from non-defective strips, comprising:

a die member having a shear zone defining edge across which successive transverse portions of said card may be traveled, a reciprocatable shear blade which is adjacent to said die member and which has a cutting edge which is coplanar with said shear zone defining edge of said die member and positioned to cut transverse strips from said card at said shear zone defining edge in a sequential manner, and a strip transporting carrier supported for movement between a first location at which a front end of said carrier is adjacent to said die member at said shear zone defining edge thereof in position to receive and support strips which are cut from said card, a second location at which non-defective strips are removable from said carrier and a third location at which defective strips are released from said carrier, wherein said carrier conveys strips along a strip travel path which extends from said first location through said second location to said third location, and, at least one retractable strip support disposed at said front end of said carrier immediately below said strip travel path, said retractable strip support being positioned to abut said die member at said shear zone defining edge thereof, said strip support being retractable into said carrier and wherein said shear blade has a blade surface which extends upward from said cutting edge and which is inclined towards said carrier, said retractable strip support being urged into said front end of said carrier by said inclined surface of said shear blade as said shear blade descends.

14. Apparatus for cutting transverse strips from an elongated card and for sorting defective strips from non-defective strips, comprising:

a die member having a shear zone defining edge across which successive transverse portions of said card may be traveled, a reciprocatable shear blade which is adjacent to said die member and which has a cutting edge which is coplanar with said shear zone defining edge of said die member and positioned to cut transverse strips from said card at said shear zone defining edge in a sequential manner, and a strip transporting carrier supported for movement between a first location at which a front end of said carrier is adjacent to said die member at said shear zone defining edge thereof in position to receive and support strips which are cut from said card, a second location at which non-defective strips are removed from said carrier and a third location at which defective strips are released from said carrier, wherein said carrier conveys said strips along a strip travel path which extends from said first location through said second location to said third location, said strip transporting carrier moving reciprocally from said third location to return to said first location.

15. The apparatus of claim 14 further including a card guide positioned to guide successive portions of cards towards said shear zone defining edge of said die member, further including an optical sensor positioned to view portions of the cards that are approaching said shear zone defining edge to detect defective areas of the cards.

* * * * *